United States Patent [19]

Noble

[11] Patent Number: 4,679,372

[45] Date of Patent: Jul. 14, 1987

[54] SPACE FRAME APPARATUS AND A SPACE FRAME EMPLOYING SUCH APPARATUS

[76] Inventor: Alfred H. Noble, 310 Highland Road, Kensington, Johannesburg, Transvaal, South Africa

[21] Appl. No.: 737,189

[22] Filed: May 23, 1985

[30] Foreign Application Priority Data

May 24, 1984 [ZA] South Africa ..... 84/3943

[51] Int. Cl.[4] ..... E04H 12/00

[52] U.S. Cl. ..... 52/648; 52/637; 52/81; 52/DIG. 10

[58] Field of Search ..... 52/648, 637, 632, 662, 52/646, 81, DIG. 10, 650, 655, 654; 403/169-171, 176, 202, 217

[56] References Cited

U.S. PATENT DOCUMENTS 3,563,580 2/1971 Black ..... 52/648 X

*Primary Examiner*—Carl D. Friedman
*Assistant Examiner*—Naoko N. Slack
*Attorney, Agent, or Firm*—Ladas & Parry

[57] ABSTRACT

A space frame unit comprises a square tray 10 with elongate members 12 extending from the corners of the tray 10 to be joined at an apex 14 where a plate 16 is fixed. The tray 10 is provided with apertures for bolts which secure adjacent trays 10 in a space frame assembly together.

4 Claims, 2 Drawing Figures

SPACE FRAME APPARATUS AND A SPACE FRAME EMPLOYING SUCH APPARATUS

BACKGROUND OF THE INVENTION

The invention relates to space frame units.

There remains a requirement to provide various novel space frame units to meet the increased demand for providing different structures in and for buildings.

SUMMARY OF THE INVENTION

According to the invention a space frame unit comprises a rectangular frame having edges which can be readily secured to the edges of adjacent frames of like units, elongate structural members extending from and fixed at their one ends adjacent each respective corner of the frame and joined together at their other ends to form an apex, and a fixing plate at the apex for joining the apex to other space frame units or supports.

The frames may be square and may be provided by the edges of trays.

The tray may be provided with upturned or downturned edges provided with apertures to enable adjacent trays to be bolted together.

The fixing plate may be arranged to hold the other ends of the structural members together to form the apex. The structural members may be joined together themselves and the plate secured to the apex formed thereby.

The apices of each unit may be joined together by elongated structural members which are connected to the fixing plates by box-like connectors.

BRIEF DESCRIPTION OF THE DRAWING

A space frame unit according to the invention will now be described by way of example with reference to the accompanying drawing in which.

DESCRIPTION OF EMBODIMENTS

Figure 1:
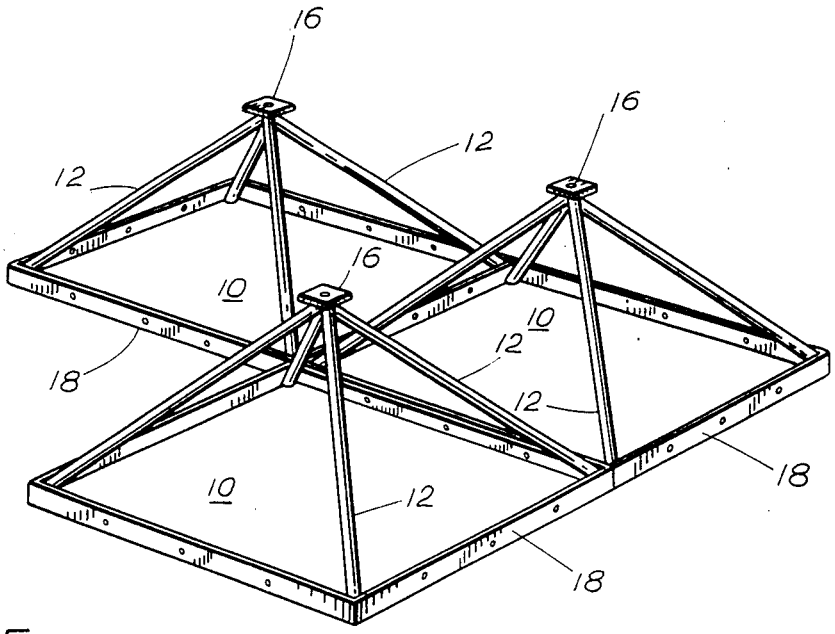
FIG. 1 shows an isometric view of three space frame units.

Referring to the drawing, in FIG. 1 each space frame unit comprises a square tray 10 with elongate members 12 extending from the corners of the trays 10 and joined to form an apex 14 to which is secured a plate 16. The plates 16 have holes for receiving bolts (not shown). The trays 10 have upstanding edges 18 each having communicating holes to allow the trays to be bolted firmly together.

Figure 2:
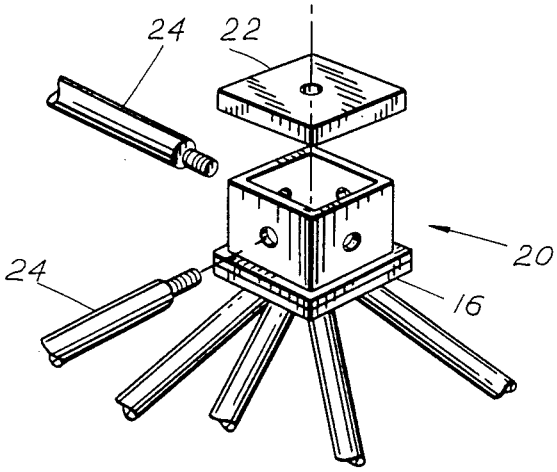
FIG. 2 shows a connector for such units.

In FIG. 2, a connector 20 comprises a box having a lid 22. Threaded cross members 24 fit into the side of the box and are fixed to the box by nuts (not shown).

Each box fits on top of a plate 16 and is held in position by a bolt (not shown) which also holds the lid 22 in position. A space frame is made up of a number of the units shown in FIG. 1 with their apices held together by the members 24.

The space frame formed by the described space frame units is particularly useful for forming a floor or deck. In that case the structure shown in FIG. 1 is inverted with the then upper surfaces of the trays 10 forming the floor or deck. Using a modification of the described trays where the edges 18 are also inverted to extend away from the members 12, the floor or deck surface can be formed of plastics compound, cement and the like. The edges of the trays 10 form suitable shallow containers into which the flooring or even a roadwork compound can be poured and allowed to set. It may be necessary or desirable to prepare or cover the surface of the trays 10 and the inner upstanding edges 18 so that the compound used does not corrode or otherwise damage the material forming the trays 10.

The connector 20 may take other forms and for example may be made with a lipped lid and lipped base which are both separable from sides of the box 20. The sides of the box may also be then permanently joined only to form two joined sides of the box, that is each part consisting of an L-shaped part. The box 20 may also be formed in a cylindrical configuaration with a separable circular lid 22 and/or separable circular base. Each or some of the trays 10 may be replaced by square frames made of angle iron or other metal bent to angle shape.

I claim:

1. A space frame unit and a hollow box connector combination.

the space frame unit comprising a substantially rectangular integral frame having edges provided with upstanding lips, said edges being connected to adjacent edges of frames of similar space frame units placed side-by-side with the space frame unit thereby connecting the frames together in side-by-side relationship; at least four elongated structural members fixedly attached to the frame at the corners of the frame and converging towards one another to form an apex of the space frame unit being substantially remote from the frame thereof;

a fixing plate arrangement at the apex permanently receiving ends of the structural members remote from the frame;

the hollow box connector comprising a lid spaced from the fixing plate arrangement, an open-ended tubular member located between the lid and the fixing plate arrangement at the apex of the space frame unit having a plurality of holes in its walls; and bolt means serving to draw the lid and the fixing plate arrangement towards one another, said bolt means passing through the tubular member, thereby holding the tubular member between the lid and the fixing plate arrangement; the holes in the tubular member permitting connection to the tubular member of crossmembers and connecting the apex of the space frame unit to the apices of the other space frame units placed side-by-side therewith.

2. A combination according to claim 1, wherein the substantially rectangular frame is in the form of a square tray having upstanding lips at its edges.

3. A space frame comprising plurality of space frame untis, a plurality of hollow box connectors, at least one hollow box connector being provided for each space frame unit, a plurality of cross-members; each space frame unit comprising a substantially rectangular integral frame having edges provided with upstanding lips connecting the edges to adjacent edges of the frames of similar frame units placed side-by-side with the space frame unit thereby connecting the frames together in side-by-side relationship;

at least four elongated structural members fixedly attached to the frame at corners of the frame and converging towards one another to form an apex of the space frame unit being substantially remote from the frame thereof; a fixing plate arrangement at the apex to which the ends of the structural members remote from the frame are permanently connected;

a lid spaced from the fixing plate arrangement; an open-ended tubular member located between the lid and the fixing plate arrangement at the apex of the space frame unit having a plurality of holes in its walls; and bolt means serving to draw the lid and the fixing plate arrangement towards one another, said bolt means passing through the tubular member, thereby holding the tubular member between the lid and the fixing plate arrangement; a cross-members span between the tubular members of the hollow box connectors associated with adjacent space frame units and connected to the tubular members at the holes in the walls thereof, the cross-members thereby serving to connect the apices of the space frame units together in a rigid space frame structure.

4. A space frame according to claim 3 wherein the substantially rectangular frame of each space frame unit is in the form of a square tray having upstanding lips at its edges.

* * * * *